US010450186B2

(12) United States Patent
Cross

(10) Patent No.: US 10,450,186 B2
(45) Date of Patent: Oct. 22, 2019

(54) HORSE BIT

(71) Applicant: Neue Schule Limited, Stokesley, North Yorkshire (GB)

(72) Inventor: Graham Hugh Cross, Stockton-on-Tees (GB)

(73) Assignee: Neue Schule Limited, North Yorkshire (GB)

( * ) Notice: Subject to any disclaimer, the term of this patent is extended or adjusted under 35 U.S.C. 154(b) by 340 days.

(21) Appl. No.: 15/506,314

(22) PCT Filed: Aug. 17, 2015

(86) PCT No.: PCT/EP2015/068842
§ 371 (c)(1),
(2) Date: Feb. 24, 2017

(87) PCT Pub. No.: WO2016/030221
PCT Pub. Date: Mar. 3, 2016

(65) Prior Publication Data
US 2017/0253475 A1 Sep. 7, 2017

(30) Foreign Application Priority Data
Aug. 27, 2014 (EP) ..... 14182500

(51) Int. Cl.
*B68B 1/06* (2006.01)

(52) U.S. Cl.
CPC ..... *B68B 1/06* (2013.01)

(58) Field of Classification Search
CPC ..... B68B 1/06
USPC ..... 54/7–9
See application file for complete search history.

(56) References Cited

U.S. PATENT DOCUMENTS 4,375,147 A * 3/1983 Conrad ..... B68B 1/06 54/8
4,566,254 A * 1/1986 Nagel ..... B68B 1/06 54/8
4,884,390 A * 12/1989 Benjak ..... B68B 1/06 54/7

(Continued)

FOREIGN PATENT DOCUMENTS

DE 8421331 U1 11/1984
DE 8624309 U1 11/1986

(Continued)

OTHER PUBLICATIONS

International Search Report from corresponding International Application PCT/EP2015/068842.

(Continued)

*Primary Examiner* — David J Parsley
*Assistant Examiner* — Danielle A Clerkley
(74) *Attorney, Agent, or Firm* — Alfred Y. Chu, Esq.; Brian B. Shaw, Esq.; Harter Secrest & Emery LLP

(57) ABSTRACT

The invention relates to a horse bit comprising a shackle (20) configured to be inserted into a horse's mouth. The shackle (20) extends along a longitudinal path (A) and has a first end (22) and a second end (24) for attachment of cheeks (120, 130, 140, 150). In a cross-section substantially perpendicular to the longitudinal path (A) the shackle (20) has at least one shackle surface region (30) comprising a linear or a concave surface profile section (32, 34).

17 Claims, 12 Drawing Sheets

(56) References Cited

U.S. PATENT DOCUMENTS

| | | | | | |
|---|---|---|---|---|---|
| 5,062,255 | A * | 11/1991 | Myler | B68B 1/06 | 54/7 |
| 5,528,884 | A * | 6/1996 | Johnson | B68B 1/06 | 54/8 |
| 6,425,229 | B2 * | 7/2002 | Sprenger | B68B 1/06 | 54/9 |
| 2008/0047236 | A1 * | 2/2008 | Hoyos | B68B 1/06 | 54/8 |
| 2008/0302069 | A1 * | 12/2008 | Stevenson | B68B 1/06 | 54/8 |
| 2009/0223182 | A1 * | 9/2009 | Vollmecke | B68B 1/06 | 54/8 |
| 2010/0170207 | A1 * | 7/2010 | Morgante | B68B 1/06 | 54/9 |
| 2013/0312375 | A1 | 11/2013 | Gaudet | | |
| 2014/0213965 | A1 * | 7/2014 | Hall | A61D 7/00 | 604/77 |

FOREIGN PATENT DOCUMENTS

| | | | | | |
|---|---|---|---|---|---|
| DE | 29803875 | U1 | 4/1998 | | |
| EP | 1140693 | B1 | 11/2003 | | |
| GB | 2413931 | A * | 11/2005 | B68B 1/06 | |

OTHER PUBLICATIONS

Written Opinion from corresponding International Application PCT/EP2015/068842.

* cited by examiner

HORSE BIT

TECHNICAL FIELD

The present invention relates to a horse bit, in particular to the shackle of the horse bit. The shackle can also be designated as mouthpiece and the horse bit can also be designated as snaffle bit for a horse.

BACKGROUND OF THE INVENTION

EP 1 140 693 B1 discloses a horse bit comprising a shackle configured to be inserted into a horse's mouth. In one embodiment a single jointed horse bit comprises two elongated side portions whose inner ends provide eyelets for interlocking and forming a joint similar to that seen in a chain-link system. This embodiment provides a single joint with free play to allow the mouthpiece to adopt a large range of positions within the mouth. In another embodiment a double jointed horse bit comprises two elongated side portions whose inner ends provide eyelets for joining loosely to a central portion which itself contains eyelets to receive the side portion eyelets to form two joints. This embodiment provides for two joints connecting the side portions to the central portion each having free play around a large range of 3-dimensional angles.

Horse bits of the prior art comprise two functional parts or groups of parts. The first part is the shackle which may comprise a system of jointed components or a single solid component configured to be inserted into the mouth of the horse. This part may also be designated as the mouthpiece part. The second parts are joined to and to either side of the shackle and lie outside of the mouth. These parts can also be designated as the cheeks. They are attached to bridlework such as reins, cheek-pieces, brow band etc. so that the mouthpiece or shackle can be mounted on the horse's head and so that forces from the rider through the attached reins can convey direction and speed commands to the horse.

Consideration of the configuration of these two separate parts or groups of parts gives the horse bit designer the opportunity to tailor the forces applied to the mouthpiece to achieve the desired objective.

The anatomical features of the mouth onto which these forces are applied are primarily the tongue, the roof of the mouth (palate) and the lip tissue lying to either side of the tongue. In most horses the tongue fills the oral cavity and any horse bit must therefore displace or compress the tongue so that it may be accommodated in the mouth if the mouth is to be closed. The lip tissue is similarly compressed if the mouth is closed. As a closed mouth is one of the desirable objectives in competitive equestrianism it is desirable that the bit is comfortable in the mouth when it is closed.

The surfaces of the mouthpiece components of the prior art horse bits comprise a circular or slightly elliptic shape when seen in a cross-section. The most common known cross-sectional profile of a shackle in the prior art is a circle but oval profiles are also commonly found. Most of these profiles may convert the applied forces into large pressures when the area of contact between the mouth and the shackle surface involves a profile with a small radius of curvature. Such a profile having a small radius of curvature acts like having a single point that makes the initial contact with the mouth tissue prior to any further compression of the tissue. Such single point contacts can lead to high contact pressure on the inner surfaces of the mouth and the discomfort this can produce in the horse causes it to relieve the pressure by opening its mouth.

It is an object of the invention to provide a horse bit comprising a shackle providing an improved distribution of the pressure onto the mouth tissue while still being comfortable within the horse's mouth. At the same time the bit should fit to the anatomy of the horse's mouth in a good manner and find good acceptance with the horse.

SUMMARY OF THE INVENTION

According to the present invention, the horse bit comprises a shackle configured to be inserted into a horse's mouth, wherein the shackle extends along a longitudinal path and has a first end and a second end for attachment of cheeks. In a cross-section substantially perpendicular to the longitudinal path the shackle has at least one shackle surface region comprising a linear or a concave surface profile section.

The shackle of the horse bit according to the invention may have different configurations. In this connection, the shackle preferably is a single bar, preferably without any joint. Alternatively, the shackle may comprise exactly one joint (single jointed horse bit), may comprise exactly two joints (double jointed horse bit) or could have more than two joints (multiple jointed horse bit). In horse bits having at least one joint, the shackle comprises at least two side portions, wherein the side portions are connected by the at least one joint such that the side portions are pivotable to each other. Moreover, such a horse bit preferably comprises at least two eyelet members each having an eyelet bore and wherein the eyelet members are interlocked via their eyelet bores to provide the at least one joint. In case of a single-jointed horse bit the shackle comprises one joint and two side portions, wherein the two side portions are connected by the joint and each side portion has an inner end with one eyelet member having the eyelet bore and wherein the two eyelet members are interlocked with play via their eyelet bores to provide the joint. In case of a double-jointed horse bit the shackle comprises two side portions and a central portion between these two side portions and two joints for connecting the central portion to the side portions. Each side portion has an inner end with one eyelet member having one eyelet bore and the central portion has two end sections wherein each end section has one eyelet member with one eyelet bore. Furthermore, each eyelet member of one end section is interlocked with play with the adjacent eyelet member of one side portion to provide a joint. Basically it is possible to have more than two side portions and/or more than one central portion.

As to the understanding of the present invention, preferably, the cross-section is a vertical cross-section and/or preferably the cross-section is perpendicular to the longitudinal path of the shackle. Further, the shackle generally extends in a length direction along the longitudinal path, e.g. of the shackle bar, of the shackle side portions and/or of the central portion. Furthermore, the shackle preferably is in a stretched position and/or preferably in a position laid on a planar horizontal surface. The overall longitudinal path preferably can extend as a straight and/or curved line. Preferably, the longitudinal path can extend within the shackle and/or along the axis of gravity. Preferably, the longitudinal path can be designated as longitudinal axis. Preferably, the shackle has an upper side related to the roof of the horse's mouth and a lower side related to the lower jaw of the horse's mouth.

Furthermore, as to the terms used in a present invention, the shackle can also be designated as a mouthpiece and the side portions may also be designated as side arms, the central portion as a centre part and the cheeks as bit side parts.

The invention describes an improvement to horse bits having a bar-like shackle or single, double or multiple jointed shackles by providing a flat or (slightly) concave cross-sectional profile such that this surface profile section of the shackle surface makes contact with the mouth tissue. One effect of the invention is that the surface area of the shackle is increased by the linear or concave profile section and that the force is spread over a larger surface area to further reduce the overall pressure and the compressed tongue and lip tissue may fill the concave space. Moreover, a linear or concave surface profile section provides for a conformal coupling between the bit surfaces and the mouth surfaces which will lead to a lessening of the tendency for the bit to slide up and down the tongue.

As a consequence stability of the bit in the horse's mouth is increased and makes the bit more effective at conveying commands from the rider and increases the comfortable action for the horse. The flattened surface profile section allows lowering of the pressure on the tongue and at the same time allows a thinner mouthpiece profile measured in the direction between the tongue plane and the palate plane. In other words, the height of the shackle in the region of the tongue and/or palate contact area can be lowered allowing the tongue to be not much further compressed.

According to a preferred embodiment, the surface profile section has two end points and a chord line connecting these two end points. Preferably, the chord line is an imaginary line and does not define the surface boundary of the shackle surface region and the surface profile section. However, preferably in case of a linear surface profile section the chord line may define the extension plane of the surface profile section. Preferably, the chord line may coincide with a tangent of the shackle surface region, in particular with a tangent of the surface profile section. Furthermore, the chord line may intersect at a tangent of the two endpoints of the cross-section profile edge. Preferably, in case of a concave surface profile section the two endpoints define the profile section within which the shackle surface has a concave profile. Preferably, the two endpoints coincide with respective points of inflection. However, basically it is also possible that the points of inflection are spaced apart from the endpoints, preferably towards the centre of the surface profile section. Preferably, the surface profile section consists of the linear or of the concave surface profile section. Preferably, the remaining surface profile section of the cross-sectional shackle surface has a circular, convex or elliptical, convex shape. Preferably, this remaining surface profile section has two end points, wherein one end point coincides with one end point of the linear or concave surface profile section and wherein the other end point coincides with the other one end point of the linear or concave surface profile section.

In a preferred embodiment the surface profile section between the two end points comprises a straight line along the chord line to form the linear surface profile section. In another preferred embodiment in case of a concave surface profile section the surface profile section comprises a concave line to form the concave surface profile section.

According to further preferred embodiments, the end points are end points of the straight line of the linear surface profile section or the end points are points of inflexion of curvature of the concave line of the concave surface profile section.

In a further preferred embodiment, the chord line, the straight line and/or the concave line has a length of between about 5 mm and about 30 mm, preferably between about 5 mm and about 15 mm.

Preferably, the surface profile section is located at a lower surface side, at an upper surface side and/or at a lateral surface side of the shackle. Preferably, surface profile section is located at the lower surface side which is related to the horse's tongue upper surface when the horse bit is inserted in the horse's mouth.

In a further preferred embodiment, the surface profile section extends over a length along the longitudinal path of the shackle, wherein the length is between about 10 mm and about 150 mm, preferably between about 30 mm and about 130 mm, more preferably between about 70 mm and about 120 mm.

Preferably, the surface profile section is located at a distance from the (longitudinal path) centre of the shackle, wherein the distance is between about 0 mm and about 60 mm, preferably between about 20 mm and about 40 mm.

In a further preferred embodiment, the radius of curvature of the concave surface profile section is between about 5 mm and about 40 mm, preferably between about 10 mm and about 20 mm. Additionally or alternatively, the maximum depth of concavity of the curvature of the concave surface profile section is between about 0.2 mm and 1 mm.

In a further preferred embodiment, the ratio of the radius of curvature of the concave surface profile section and the distance between the two end points, at the point of maximum depth of concavity is between 1 and infinity, preferably between 1 and 8.

According to a further preferred embodiment, the first end and/or the second end comprises a bore for receiving the cheeks and wherein an angle between the bore axis and an axis substantially parallel to the chord line is in a range of between about 20° and about 75°, more preferably in a range of between about 25° and about 70°.

The reason for this range of angles is the operation of the cheeks and attached bridlework which varies and therefore leads to a variety of alignments of the bit in the mouth. As there are a plurality of individual cheeks and bridlework arrangements resulting in different operations it is desirable to describe relationships between different types of horse bits mainly categorised by their cheek and bridlework arrangements which will result in the correct co-alignment of any desired flat or concave surface profile and the surfaces of the horse's mouth.

In order to achieve the best possible orientation of the horse bit within the horse's mouth and corresponding pressure acting on the mouth tissue it is preferred to define an angle between the bore axis of the ends of the shackle and the chord line, that means a line substantially parallel to the chord line such that a flat or concave surface profile section is oriented correctly such that the surface profile section is approximate in parallel contact with the plane of the tongue. Preferably, this angle lies in a range of between about 25° and about 75°.

In a preferred embodiment, the angle is in a range of between about 55°±5°, preferably where the cheeks act as a member of a first type of cheek having a single rein attached (directly) to a ring that is free to slide through the bore. In a further preferred embodiment, the angle is in a range of between about 65°±5°, preferably where the cheeks act as a member of a second type of cheek having a rein attached to a ring that lies below an origin (or the level) of the bore. In a further preferred embodiment, the angle is in a range of between about 30°±5°, preferably where the cheeks act as a member of a third type of cheek having a rein attached (directly) to a ring fixed in relation to the bore and a cheek bar the longitudinal axis of which extends through the bore and wherein a cheek-piece attachment ring is provided at the end of the cheek bar.

Specifically, in particular for each of these identified types or classes of horse bits, a preferred angle is provided between the bore axis at the distal end of the shackle and an axis that is defined as lying perpendicular to the longitudinal path of the shackle and parallel to a planar or convex surface on the mouthpiece. Alternatively, the bore axis may be aligned at a specific angle to a line perpendicular to the longitudinal path of the mouthpiece that lies at a tangent to a slightly concave surface aligned substantially parallel to an axis lying along this approximately planar profile.

This achieves the alignment of the linear or concave surface profile section with the approximate plane of the horse's tongue under conditions of normal riding where the external applied forces governed by the configuration of the cheeks and bridlework are fixed in specific related directions. The net balance of forces during riding co-aligns the surface of the mouthpiece having only either an infinite radius of curvature or a finite concave radius of curvature with the sensitive mouth surfaces.

In a further preferred embodiment, the shackle has a curvature along the longitudinal path of the shackle, wherein preferably the radius defining the curvature is oriented substantially parallel to the radius of concavity of the concave surface profile section. Preferably, the curvature of the shackle can be divided into several sections along the longitudinal path and the sections can have different curvatures. For example, for a multiple-jointed shackle, the side portions can have a curved shape along their length paths. Preferably, the curvature is convex such that the center of curvature lies below the horse's tongue. Each side portion can have several adjacent or side-by-side sections having different but continuously merging curvatures.

Providing an overall arched profile for the horse bit mouthpiece that aligns over the natural arch formed by the tongue and lips of the horse brings the advantages that the horse cannot so easily push its tongue out of the side of the mouth nor can the mouthpiece so easily be dragged by the actions of the rider over to one side of the mouth.

According to a further aspect of the present invention a method of determining the preferred angle between the bore axis and the chord line of a horse bit's shackle will now be described. The shackle extends along a longitudinal path and has a first end and a second end, each end comprising a bore for receiving the cheeks of the horse bit. The method comprises the following steps: In a first step, the extension direction of the bore axis of the bore when the shackle is inserted into a horse's mouth is determined and an angle between the bore axis and a reference plane or axis (or line) of the horse's head is measured. In a second step, a surface profile section, preferably a chord line, defining a desired surface profile section of the shackle surface profile is determined by correcting the measured angle by a predetermined angle correction value. In a third step, the surface profile section is set using the surface profile section angle, preferably the chord line angle, in relation to the bore axis.

Generally, the method preferably relates to the horse bit, and in a preferred embodiment, the surface profile section is linear or concave and may have any of the above explained preferred features.

Preferably, the reference plane or line of the horse's head is designated by the plane or line of the nasal bone, in particular when the horse's head is in a position such that the nasal bone line extends substantially vertically. Preferably, in the first step, the extension direction of the bore axis of the bore is determined when the shackle is inserted into a horse's mouth while the rider applies normal tension to the reins. For example, the extension direction of the bore axis of the bore is determined when the horse's head is in a position such that the nasal bone line extends substantially vertically. Preferably, the measured angle is corrected by a predetermined angle correction value in the range of between 5° and 15°, in particular in the amount of about 10°. Preferably, the extension direction of the bore axis and the angle between the bore axis and a reference plane or line of the horse's head is measured/determined under use of a measuring device.

The method provides the advantages that no x-ray studies are necessary as may be thought required to determine internal anatomical and mouthpiece surface co-alignment and is therefore simple to implement by a competent person. Preferably, the rider sits in the normal riding position when the horse bit and the bridlework are assembled as required and tension on the reins is applied bilaterally until the horse is encouraged to adopt a suitable head position, preferably such that in a lateral view of the horse's head the edge line along the nose as a reference plane or axis for the anatomy of the head. This reveals the nasal bone line. For example, a photograph in profile can then be taken from which information can be gathered.

Generally, the angle is corrected by an angle correction value considering the angle between the nasal bone line and the horse's tongue plane line to better represent the tongue plane line orientation. Thus, the axis of the bore can be identified and its angle in relation to the tongue plane can then be defined. Finally, one can then set the flat straight or concave surface profile section at the specific orientation to the bore axis so that it will be aligned parallel to the tongue plane when the rider has encouraged his horse to adopt any desired head position.

The description of the invention that follows will be made preferably in terms of double-jointed horse bits but it will be apparent to the skilled person that the principles of the invention will equally well apply to single-jointed horse bits and to multiple jointed horse bits and to horse bit having no such joint in general, e.g. a shackle bar.

BRIEF DESCRIPTION OF THE DRAWING FIGURES

In the following the invention will be explained, by way of preferred embodiments, in more detail with reference to the drawings.

DETAILED DESCRIPTION OF THE INVENTION

Figure 8:
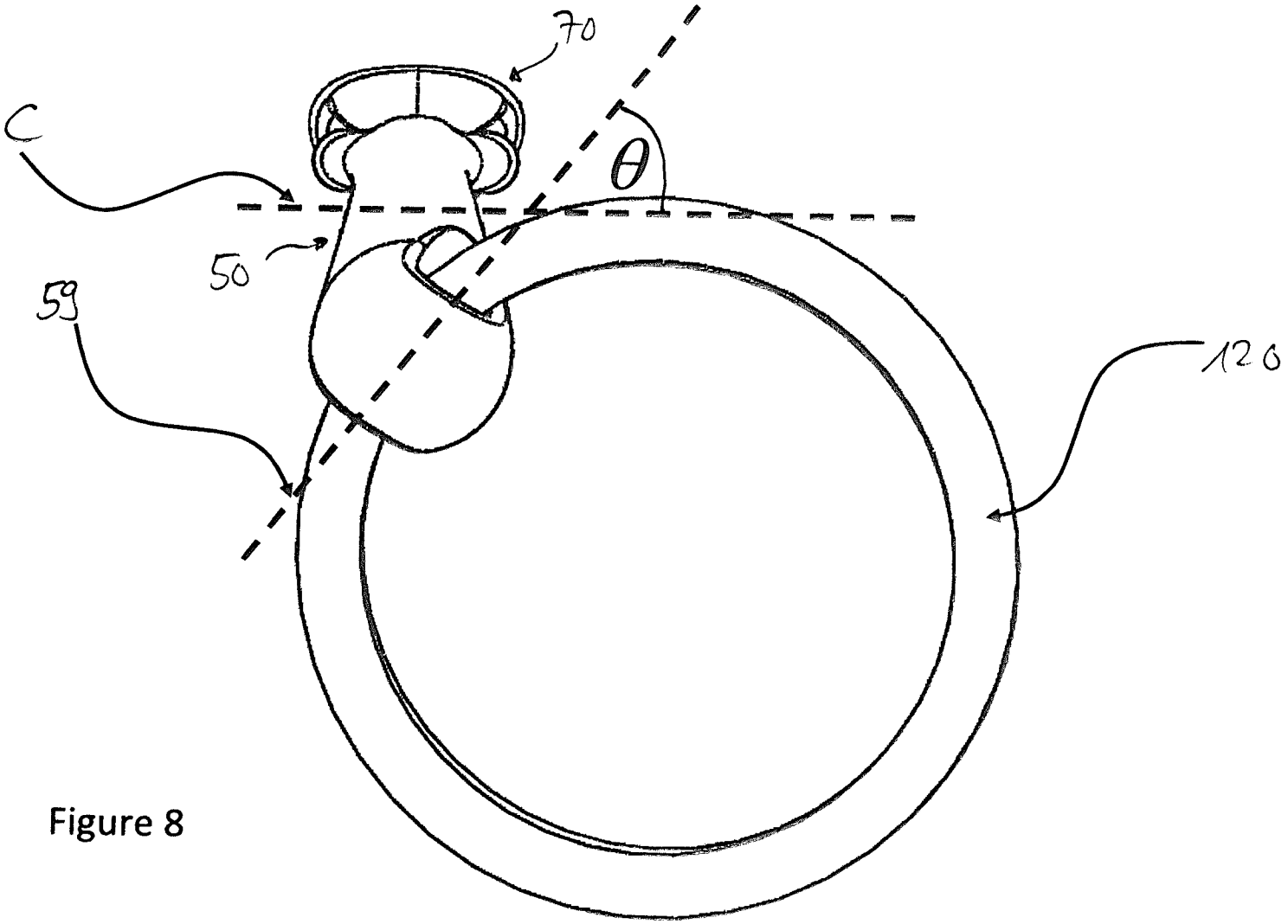
FIG. 8 is a side view of the shackle according to the first embodiment of the present invention having a first type of cheek mounted to the shackle.
Figure 9:
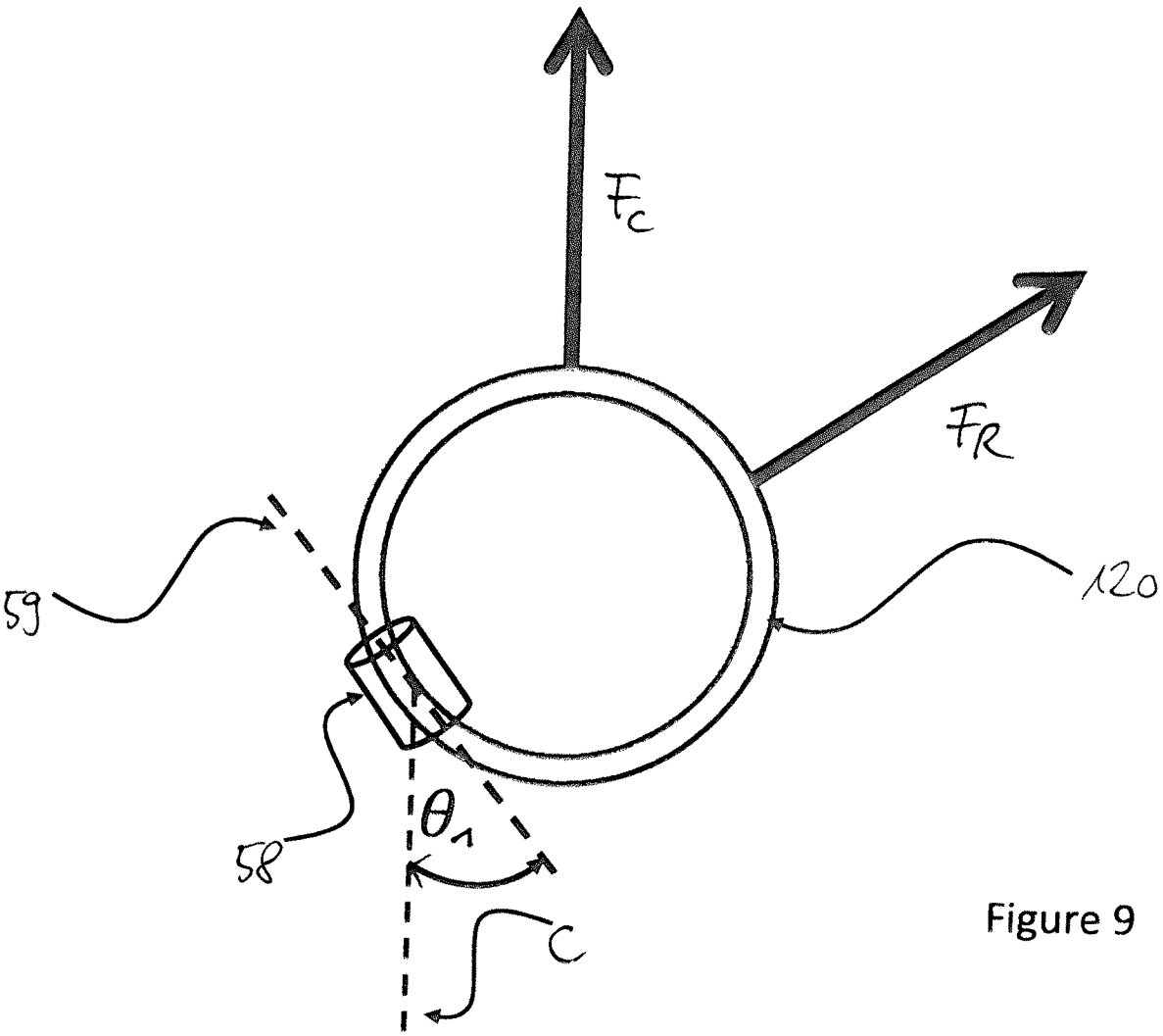
FIG. 9 is a schematic principal side view of the first type of cheek and bore of the shackle.
Figure 10:
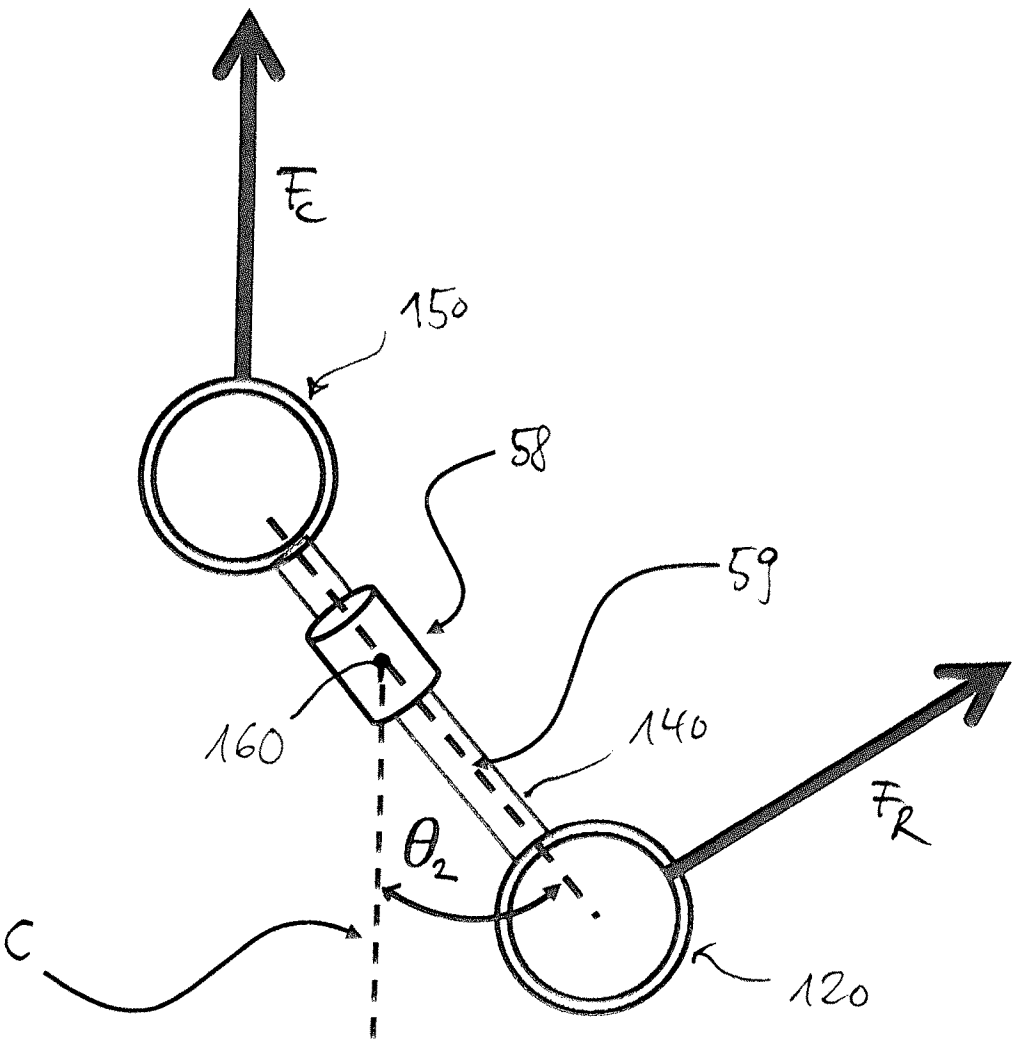
FIG. 10 is a schematic principal side view of the second type of cheek and bore of the shackle.
Figure 11:
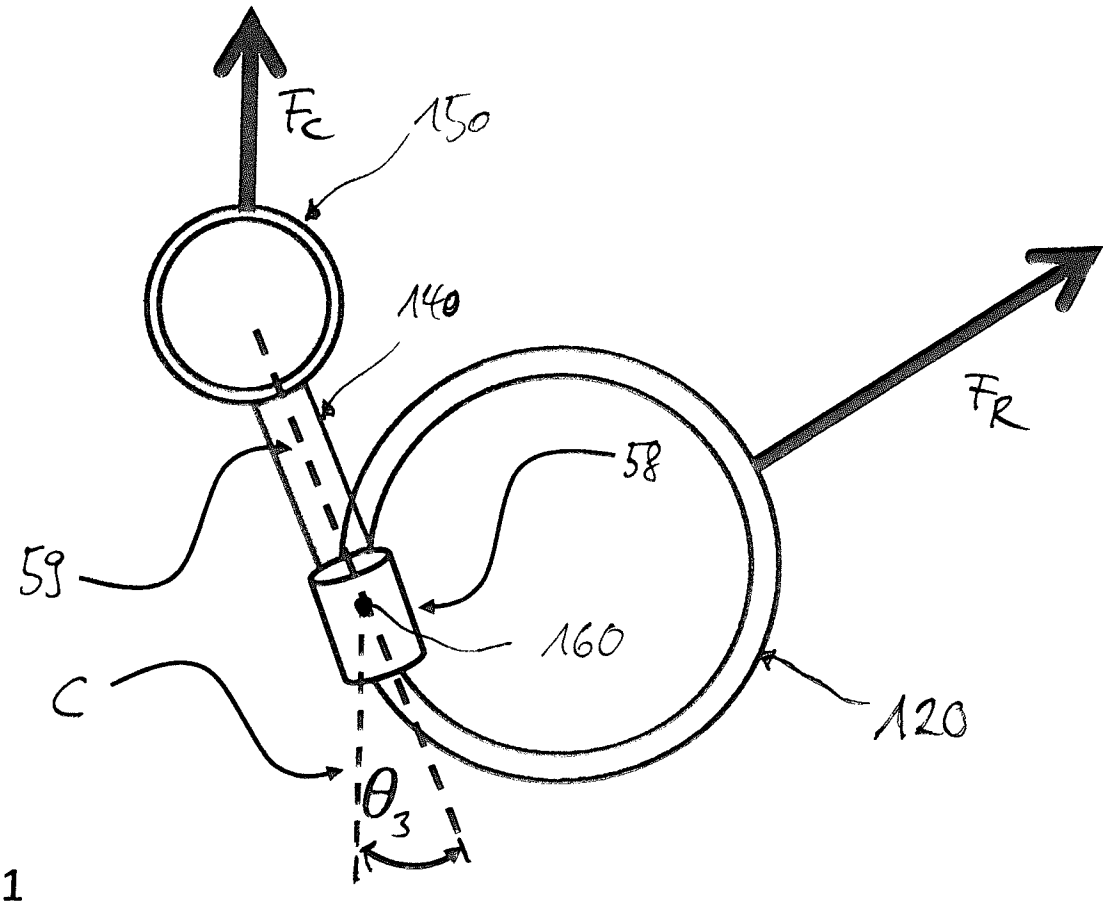
FIG. 11 is a schematic principal side view of the third type of cheek and bore of the shackle.

FIGS. 1 to 5 and 7 to 12 show a first embodiment of a horse bit 10 according to the present invention. In FIGS. 10 and 11 the first embodiment is shown with alternative cheeks. FIG. 6 shows a second embodiment of a horse bit 10 according to the present invention.

Figure 2:
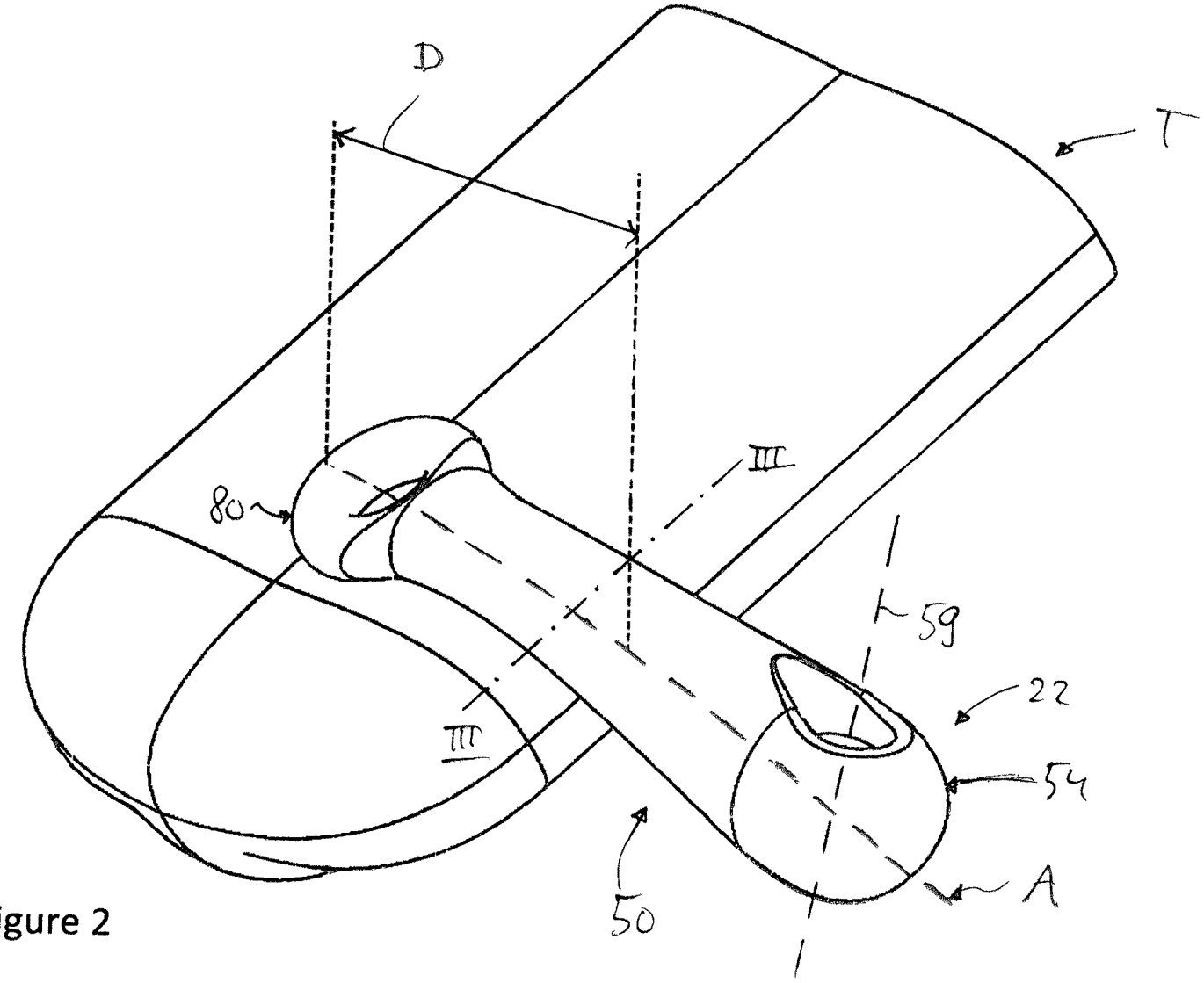
FIG. 2 is a perspective view of a side portion of the shackle of the first embodiment shown in FIG. 1 and its position when lying on a horse's tongue.
Figure 12:
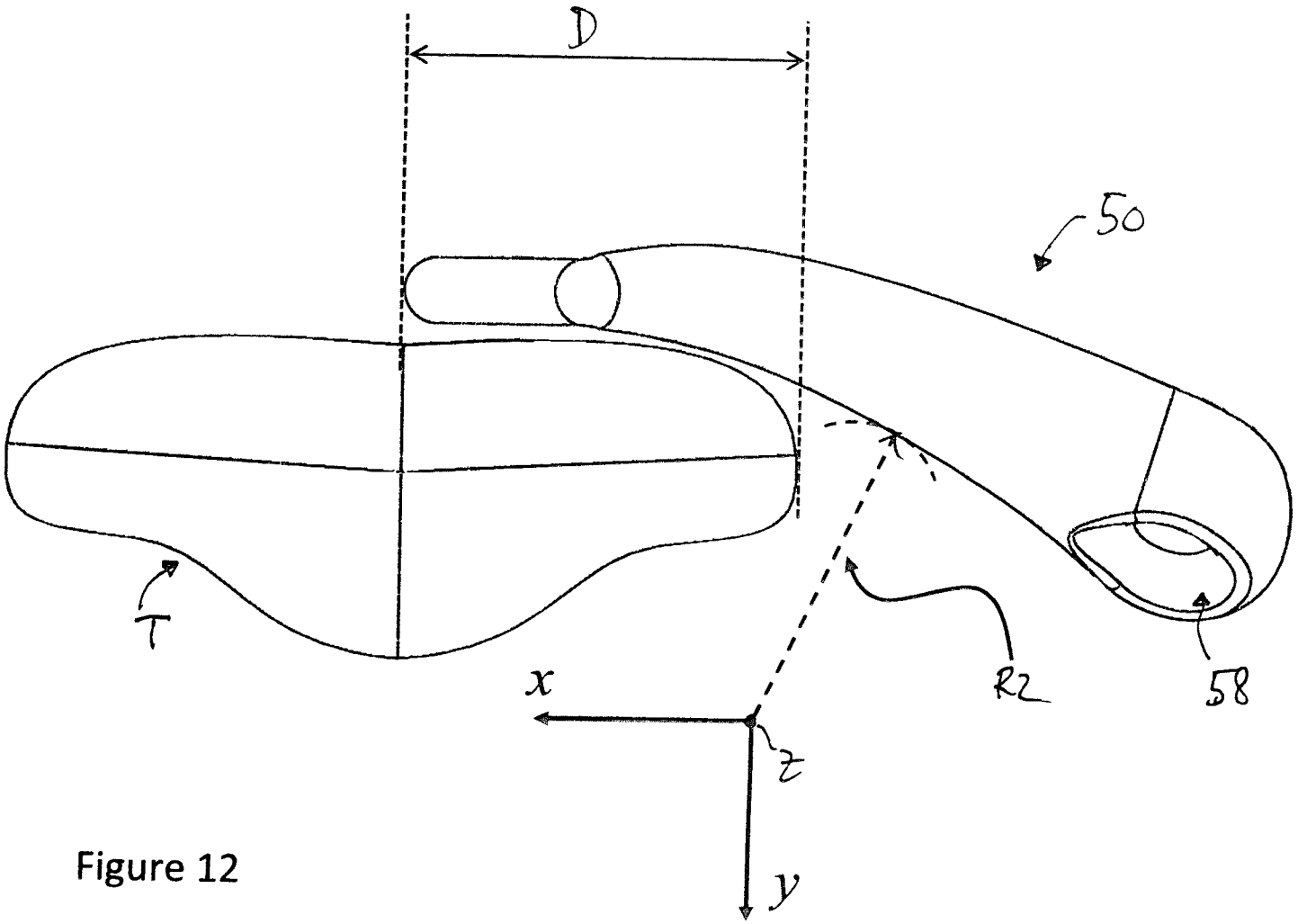
FIG. 12 is a schematic front view of the side portion of the shackle according to the first embodiment of the present invention.

The horse bit 10 according to the first embodiment comprises a shackle 20 configured to be inserted into a horse's mouth such that the shackle 20 extends over the horse's tongue and lies between the horse's tongue and the horse's palatine (as indicated in FIGS. 2 and 12). The shackle 20 extends along a longitudinal path A. Preferably, the longitudinal path A is at least slightly curved and/or extends along the centre line of the shackle 20 (or its parts). An upper surface side 26 of the shackle 20 faces to the horse's palatine and a lower surface side 27 of the shackle 20 faces to the horse's lower jaw. Further, the shackle surface includes two lateral surface sides 28. Before defining the shackle surface and its cross-sectional profile in more detail first the single parts of the horse bit 10 are described.

Figure 1:
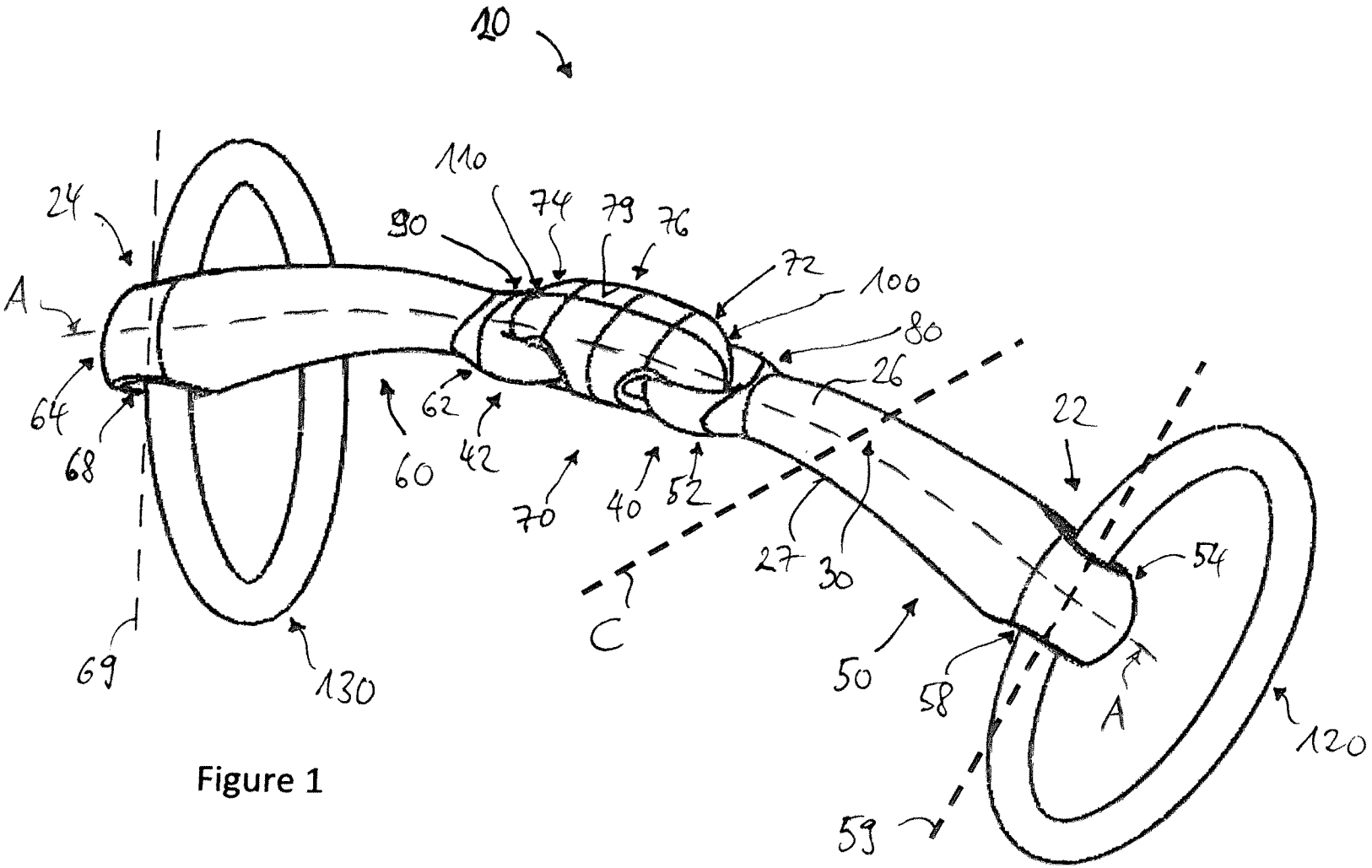
FIG. 1 is a perspective view of a first embodiment of a horse bit according to the present invention.

The shackle 20 comprises a first end 22 and a second end 24. Each end 22, 24 comprise a bore 58, 68 which will be described in further details below. The ends 22, 24 and thus the bores 58, 28 are configured to receive the cheeks of the horse bit, in particular rings 120,130 which are explained in more detail in connection with FIGS. 8 to 11. FIG. 1 shows a first ring 120 for attachment of reins and which extends through the bore 58 such that the ring 120 is free to slide through the bore 58. Further, there is a second ring 130 for attachment of reins. The second ring 130 extends through the bore 68 such that the ring 130 is free to slide through the bore 68. Preferably, the axes 59, 69 extend perpendicular to the longitudinal path of the shackle 20.

Further, the shackle 20 comprises two side portions 50, 60 and a central portion 70 between the two side portions 50, 60, wherein the two side portions 50, 60 are connected via the central portion 70 and two joints 40, 42 such that the side portions 50, 60 are pivotable to each other and/or to the central portion 70. The two joints 40, 42 connect the central portion 70 to the side portions 50, 60. Preferably, the two side portions 50, 60 are arm-shaped.

The central portion 70 comprises an end section 72 and end section 74 and a central section 76 connecting the end sections 72, 74, wherein the central portion 70 preferably is a one-piece integral member.

Further, the shackle 20 comprises four eyelet members 80, 90, 100, 110 which are preferably ring-shaped.

To this end, the inner end 52 of side portion 50 is shaped as the eyelet member 80 having the eyelet bore extending along an eyelet bore axis. Correspondingly, the inner end 62 of side portion 60 is shaped as the eyelet member 90 having the eyelet bore extending along an eyelet bore axis.

Further, end section 72 of the central portion 70 comprises an eyelet member 100 with an eyelet bore extending along an eyelet bore axis. Correspondingly, end section 74 comprises an eyelet member 110 with its eyelet bore extending along an eyelet bore axis.

The eyelet members 80 and 100 are interlocked with play via their eyelet bores to provide the joint 40 and the eyelet members 90 and 110 are interlocked with play via their eyelet bores to provide the joint 42. In other words, the two joints 40, 42 are formed by the four eyelet members 80, 90, 100, 110.

Generally speaking, the shackle 20 extends along the longitudinal path A formed by the length path of side portion 50, the length path of the central portion 70 and the length path of the side portion 60. An outer end 54 of the side portion 50 provides the first end 22 of the shackle 20 and an outer end 64 of the side portion 60 provides the second end 24 of the shackle 20. As further shown, the side portions 50, 60 have a curved shape along their length paths. Preferably, the curvature is convex such that the center of curvature lies below the horse's tongue. Each side portion 50, 60 can have several adjacent sections having different but continuously merging curvatures. Thus, the overall longitudinal path of the shackle 20 as a whole can adopt a curved orientation in the horse's mouth, which will be described further below in connection with FIG. 12.

Now, the shackle surface and its cross-sectional profile are described in more detail and referring to FIGS. 2 to 7.

FIG. 2 shows a perspective view of the side portion 50 having the improved shackle surface region 30 placed onto a model of the horse's tongue T and aligned as if during riding. The lower surface side 27 is aligned parallel to the plane of the tongue T. A perspective view of a cross-section of the side portion 50 having the improved shackle surface region 30 is shown in FIG. 3.

Figure 3:
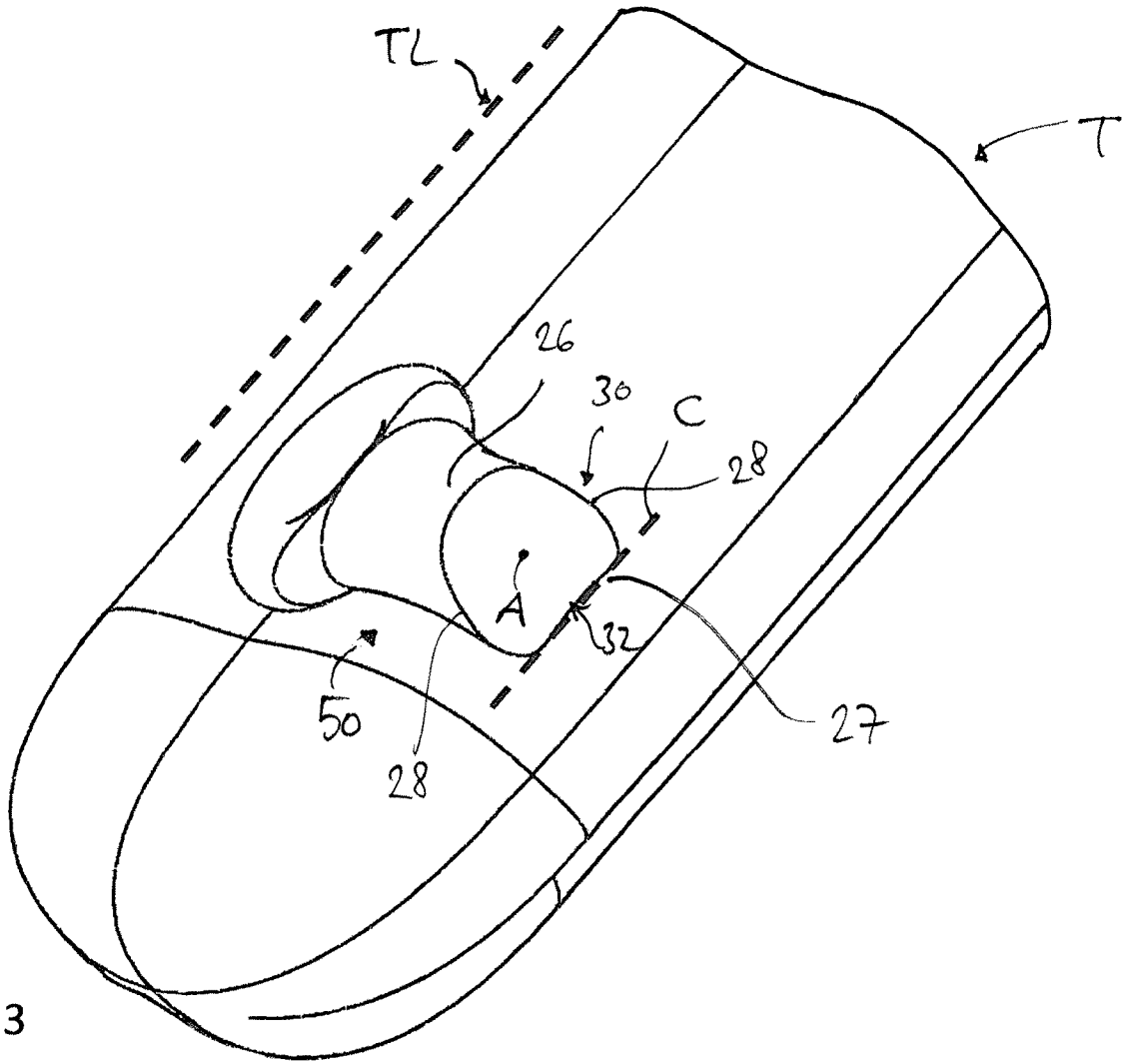
FIG. 3 is a perspective view of a cross-section of the side portion shown in FIG. 2 along line III-III in FIG. 2.

FIG. 3 shows the cross-sectional surface profile of the shackle according to the invention, namely the shackle surface region 30 comprising a concave surface profile section 32 which is provided at the lower surface side 27 of the side portion 50. The cross-section is taken perpendicular to the longitudinal path A of the shackle 20.

Figure 4:
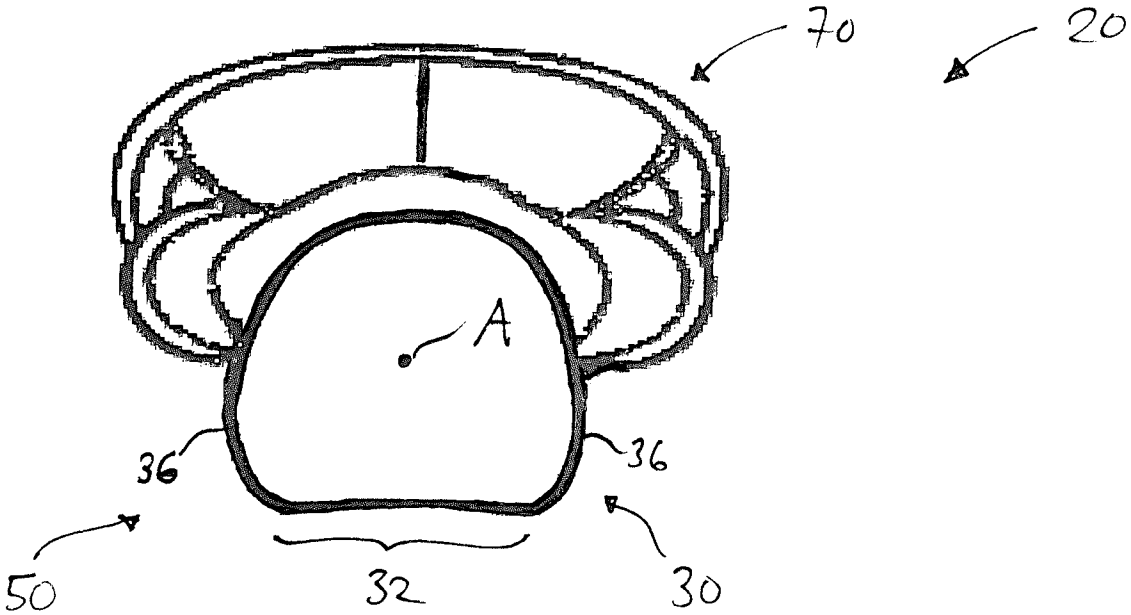
FIG. 4 is a cross-sectional view of the side portion shown in FIG. 3.
Figure 5:
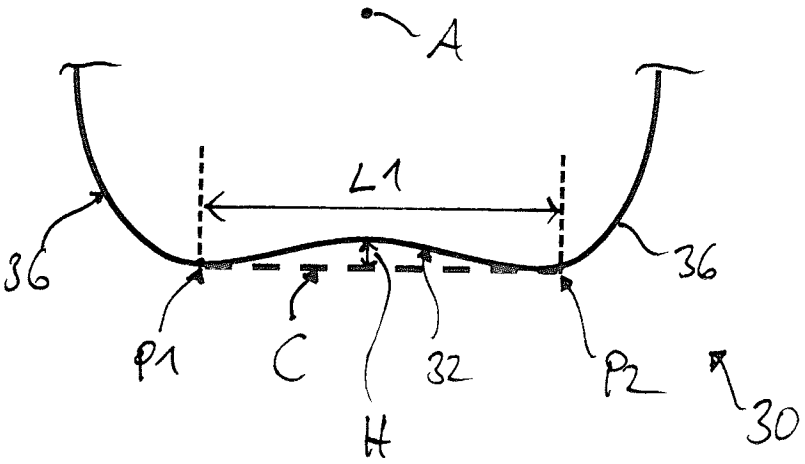
FIG. 5 is an enlarged and partial cross-sectional view of the side portion shown in FIG. 3, 4.
Figure 6:
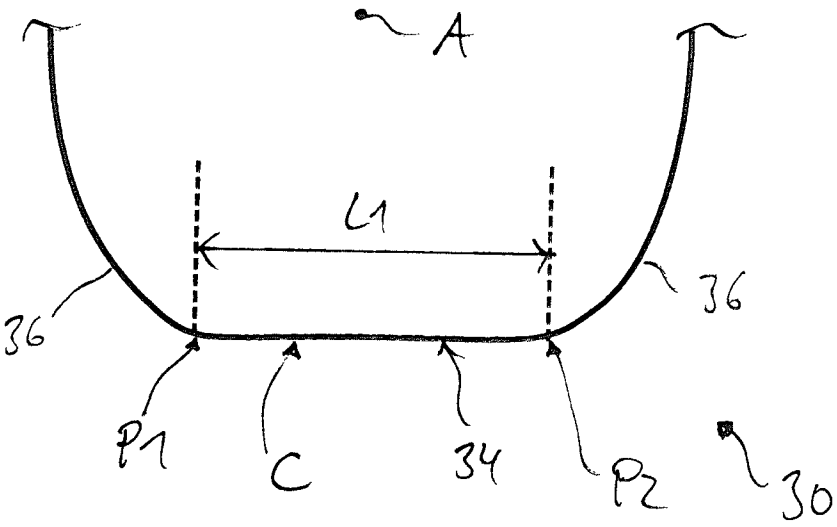
FIG. 6 is an enlarged and partial cross-sectional view similar to FIG. 5 of a shackle according to a second embodiment of the invention.

As can be seen in enlarged and more detailed FIGS. 4 and 5 the concave surface profile section 32 has two end points P1 and P2 and a chord line C. The imaginary chord line C connects the two end points. Preferably, the chord line C is parallel to or coincides with the axis or plane of cross-section.

FIG. 3 further shows that the chord line C is parallel to a line drawn normal to the transverse section of the horse's tongue. This parallel line can be designated the tongue plane line TL.

Referring back to FIGS. 4, 5 and 7, the concave surface profile section 32 comprises (or consists of) a concave line section between the two end points P1, P2 to form the concave surface profile section 32. The end points P1, P2 preferably are points of inflexion of curvature of the concave line of the concave surface profile section 32. The remaining surface profile section 36 of the shackle surface profile preferably is convex, circular or elliptical. Preferably, the concave line has a length L1 of between about 5 mm and about 30 mm, preferably between about 5 mm and about 15 mm.

Further, the concave surface profile section 32 extends over a length along the longitudinal path A of the shackle 20, wherein the length is preferably between about 10 mm and about 150 mm, preferably between about 30 mm and about 130 mm. In the present example, the minimum length over which the concave surface profile 32 extends is about 60 mm.

Preferably, the concave surface profile section 32 is located at a distance D from the centre of the shackle, wherein the distance D is preferably between about 20 mm and about 40 mm. The centre can be identified as the centre of the central portion 70 (seen along the longitudinal path A). In the present example, the concave surface profile section 32 is located at a distance D of about 35 mm.

Preferably, the maximum depth H of concavity of the concave surface profile section 32 is between 0.2 mm and about 1 mm. Preferably, the point of maximum depth of concavity lies at a distance of about 40 mm (±10 mm) from the centre of the shackle 20.

Figure 7:
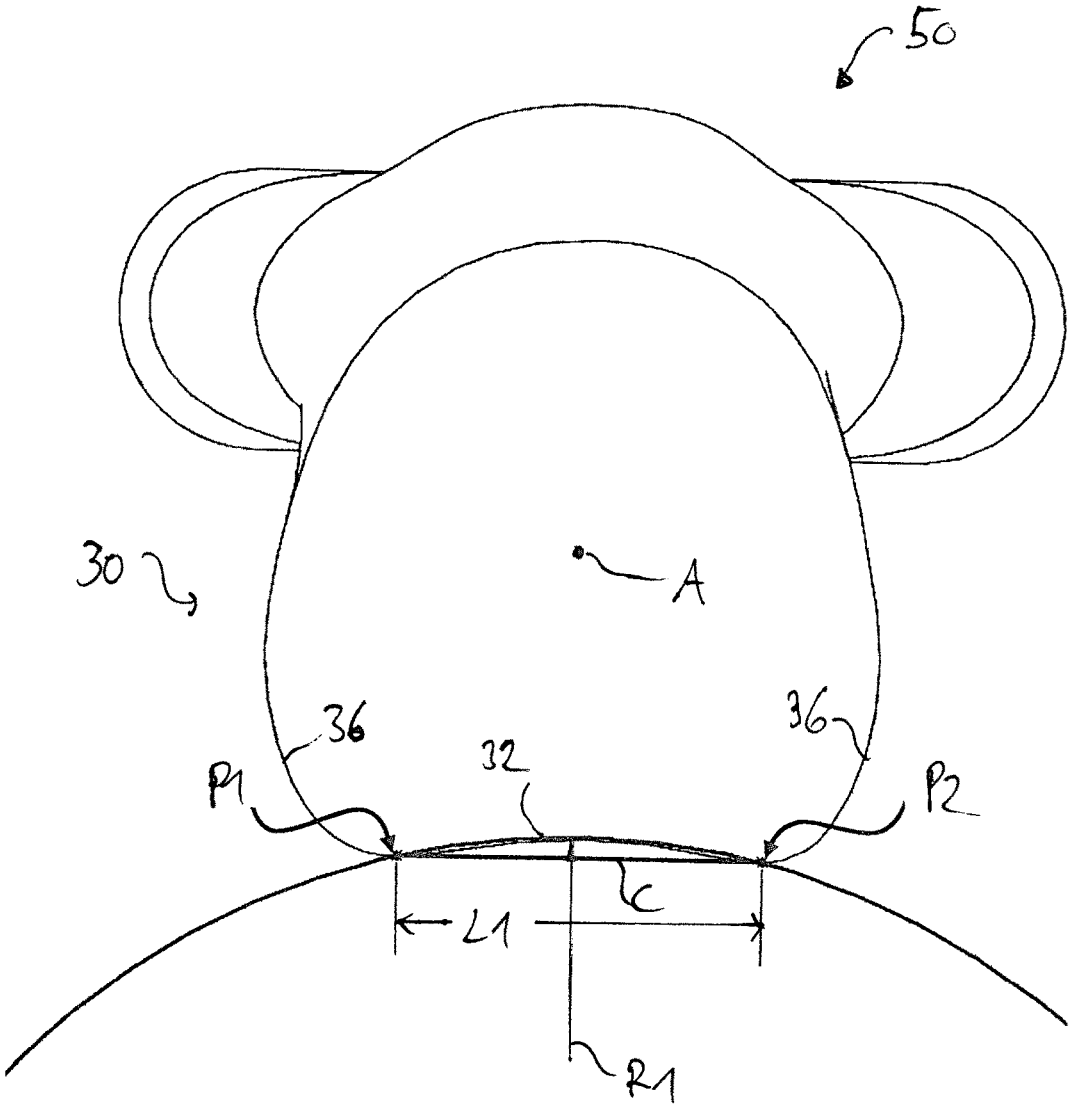
FIG. 7 is a more detailed cross-sectional view of the side portion of the first embodiment as shown in FIG. 4, 5.

As shown in FIG. 7, the chord line C preferably is a chord of a circle external to the cross-section and having the average radius R1 of the concavity. Preferably, the chord line C intersects at a tangent the two points of inflexion of the cross-section profile edge. The ratio of the average radius of curvature of the concave surface profile section 32 and the distance L between the points of inflexion, at the point of maximum depth H of concavity is between 1 and infinity. Preferably, the length of the chord line C is not less than 5 mm.

FIG. 6 shows the cross-sectional surface profile of the side portion of a shackle according to a second embodiment of the invention. FIG. 6 shows an enlarged and partial cross-sectional view similar to FIG. 5. The only difference between the above explanations relating to the first embodiment is that according to the second embodiment the shackle surface region 30 comprises a linear surface profile section 34 instead of the concave surface profile section 32.

As can be seen in FIG. 6 the linear surface profile section 34 has two end points P1 and P2 and a chord line C. The chord line C connects the two end points P1, P2. Preferably, the chord line C is parallel to or coincides with the axis or plane of the cross-section. In FIG. 6 a straight line is shown along the profile edge of the strictly flat surface section 34 where the line length is bounded between the two end points P1, P2 which also can be designated as points of departure. Like in FIG. 3, again the chord line C is parallel to the tongue plane line TL drawn normal to the transverse section of the horse's tongue. The linear surface profile section 34 comprises (or consists of) the straight line section between the two end points P1, P2 to form the linear surface profile section 34. The end points P1, P2 are points of departure of the curvature of the remaining surface profile section 36 which is convex, circular or elliptical. Preferably, the straight line has a length L1 of between about 5 mm and about 30 mm, preferably between about 5 mm and about 15 mm.

Further, the linear surface profile section 34 can extend over a length along the longitudinal path A of the shackle 20, wherein the length is preferably between about 10 mm and about 150 mm, preferably between about 30 mm and about 130 mm. In the present example, the minimum length over which the linear surface profile 34 extends is about 60 mm. Preferably, the linear surface profile section 34 is located at a distance D from the centre of the shackle, wherein the distance D is preferably between about 20 mm and about 40 mm. The centre can be identified as the centre of the central portion 70 (seen along the longitudinal path A). In the present example, the linear surface profile section 34 is located at a distance D of about 35 mm.

A further aspect of the present invention relates to the definition of a specific angle θ ($\theta_1$, $\theta_2$, $\theta_3$) between the bore axis 59, 69 of the ends 22, 24 of the shackle and the chord line C. FIG. 8 shows this angle θ in general. To effect the parallel alignment of the chord line C and tongue plane line TL during normal riding, the design of the cheeks and the method of transfer of forces from the bridlework to the mouthpiece must be taken into account.

To this end, in FIGS. 9, 10 and 11 three different cheek types/arrangements are shown each having a specific angle $\theta_1$, $\theta_2$, $\theta_3$ between the bore axis 59, 69 of the bore 58, 68 and an axis substantially parallel to the chord line C. In general, the angle θ is in a range of between about 20° and about 75°, more preferably in a range of between about 25° and about 70°.

A first class of cheek type is shown in FIG. 9 which is class A. The cheek acts as a member of a first type of cheek having a single rein attachment ring 120. The ring 120 is free to slide through the bore 58 of the shackle 20 and through the attached ends of the bridlework so that forces may be transferred from the bridlework to the ring 120 along vectors defined by FR and FC respectively. The force FC is created by the tensioning of a piece of bridlework known as the cheek-piece. The magnitude of this force is usually less than 5 N and serves to suspend the mouthpiece in the mouth with some extra tension usually determined by observing creases in the corners of the lips of the horse. Without rein tension, the initial angle θ between the bore axis 59 of the mouthpiece and the tongue plane line TL is dominated by this small tension and is approximately 90°. When rein tension FR of a magnitude greater than FC is applied through the reins from the rider's hands the mouthpiece reorients itself to a new equilibrium position and relative orientation and remains in this fixed orientation regardless of any change in magnitude of FR provided it remains higher than FC and that the rider's hands do not move much from their normal riding position. Therefore, the angle $\theta_1$ between the bore axis 59 and the tongue plane line TL is substantially constant in all relevant riding situations. In the preferred embodiment shown in FIG. 9 where the ring 120 (cheek) acts as a member of Class A, the angle $\theta_1$ between the bore axis 59 and chord line C is $\theta_1$=55°±5°.

A second class of prior art cheek type is defined as that depicted in FIG. 10 and is class B. The cheek acts as a member of a second type of cheek having a rein attachment to a ring 120, that lies below an origin 160 of the bore 58. The cheek-piece attaches to a ring 150. Preferably, both rings 120, 150 are connected to a cheek bar 140. Without rein tension, the cheek-piece force suspends the mouthpiece such that the angle $\theta_2$ between the bore axis 59 and tongue plane axis TL is approximately 0°. The rein force is applied some distance below the origin 160 of the bore 58 such that the line of action of the rein force FR is therefore not always directed through the origin of the mouthpiece bore. As such a torque on the mouthpiece is produced tending to produce a rotation of the mouthpiece around its longitudinal path with the axis of rotation centred on the origin 160 of the bore 58. Upon application of forces such that FR>FC and upon reaching equilibrium (either determined by the cancelling of opposing torques or the attainment of a rotation of the cheek that leads to line of action of FR passing through the origin 160 of the bore 58) the bore axis 59 attains an angle $\theta_2$=65°±5° with respect to the tongue plane line TL. In the preferred embodiment shown in FIG. 10 where the cheek acts as a member of Class B, the angle $\theta_2$ between the bore axis 59 and chord line C is $\theta_2$=65°±5°.

A third class of prior art cheek type is defined as that depicted in FIG. 11 and is class C. The cheek acts as a member of a third type of cheek having a rein attached to a ring 120 fixed relative to the bore 58 and a cheek bar 140 the longitudinal axis of which extends through the bore 58. The cheek-piece is attached to the ring 150 provided at the end of the cheek bar 140. The line of action of the cheek-piece force FC is directed along the mouthpiece bore axis without rein tension. Upon application of forces such that FR>FC and upon reaching equilibrium where FR passes through the origin 160 of the bore 58 the mouthpiece bore axis attains an angle $\theta_3$=30°±5° with respect to the tongue plane line TL. In the preferred embodiment shown in FIG. 11 where the cheek acts as a member of Class C, the angle $\theta_3$ between the bore axis and chord line is $\theta_3$=30°±5°.

Whilst these three classes of cheek type have been identified to exemplify the invention it is recognised that further classes may be found or alternative arrangements of bridlework may be used that define different angles θ to those described.

In FIG. 12 a further benefit can be seen according to which the overall arched profile of the shackle 20 is shown. The shackle 20 can be arranged to fit over the whole tongue so that the tongue is held under the mouthpiece arch when sufficient rein tension is applied. To achieve this objective, the shackle 20 has a curvature along the longitudinal path A of the shackle, wherein the radius R2 defining the curvature of the mouthpiece arch is oriented substantially parallel to the radius R1 of concavity of the concave surface profile section 32 and in the x-y plane as shown in FIG. 12. Both R1 and R2 lie in the x-y plane. The required angle between the radius of the mouthpiece arch and the bore axis is therefore 90-θ.

According to a further advantage the central portion 70 has a top surface 79 (related to the horse palatine) which is flattened and which is enlarged compared to the end sections 72, 74 and/or the eyelet members 80, 90 of the side portions 50, 60. Moreover, the curved shape prevents any sharp edges. The shape of the central portion 70 is particularly preferred due to the provision of an enlarged, flattened and/or curved upper surface 79 to reduce the pressure that may be applied to the sensitive roof of the mouth of the horse. Removing pressure from the roof of the mouth is a beneficial feature for the comfort of the horse.

Due to the symmetrical configuration of the side portions 50, 60 and the central portion 70, the above explanations as to the cross-section and cross-sectional surface profile of side arm 50 apply in the same manner also to the cross-section and cross-sectional surface profile of side arm 60 for all above mentioned embodiments.

| List of Reference Signs | |
|---|---|
| 10 | horse bit |
| 20 | shackle |
| 22 | first end |
| 24 | second end |
| 26 | upper surface side |
| 27 | lower surface side |
| 28 | lateral surface side |
| 30 | shackle surface region |
| 32 | concave surface profile section |
| 34 | linear surface profile section |
| 36 | surface profile section |
| 40 | joint |
| 42 | joint |
| 50 | side portion |
| 52 | inner end |
| 54 | outer end |
| 58 | bore |
| 59 | bore axis |
| 60 | side portion |

-continued

| List of Reference Signs | |
|---|---|
| 62 | inner end |
| 64 | outer end |
| 68 | bore |
| 69 | bore axis |
| 70 | central portion |
| 72 | end section |
| 74 | end section |
| 76 | central section |
| 79 | top surface |
| 80 | eyelet member |
| 90 | eyelet member |
| 100 | eyelet member |
| 110 | eyelet member |
| 120 | ring |
| 130 | ring |
| 140 | bar |
| 150 | ring |
| 160 | origin of the bore 58 |
| A | longitudinal path |
| C | chord line |
| P1 | end point |
| P2 | end point |
| L1 | length |
| D | distance |
| H | depth |
| R1 | radius of concavity |
| R2 | radius of curvature |
| T | tongue |
| TL | tongue plane line |
| θ | angle |
| $\theta_1$ | angle |
| $\theta_2$ | angle |
| $\theta_3$ | angle |
| x | axis |
| y | axis |
| z | axis |

The invention claimed is:

1. A horse bit comprising a shackle configured to be inserted into a horse's mouth, the shackle extending along a longitudinal path (A) and having a first end and a second end for attachment of cheeks, wherein in a cross-section substantially perpendicular to the longitudinal path (A) the shackle has at least one shackle surface region comprising one of a linear surface profile section and a concave surface profile section, wherein at least one of the profile sections has two end points and a chord line (C) connecting the two end points and wherein at least one of the first end and the second end comprises a bore for receiving the cheeks and wherein an angle between a bore axis of the bore and an axis substantially parallel to the chord line (C) is in a range of between about 20° and about 75°.

2. The horse bit according to claim 1, in which at least one of the profile sections between the two end points comprises one of a straight line along the chord line to form the linear surface profile section and a concave line between the two end points to form the concave surface profile section.

3. The horse bit according to claim 2, in which the end points are one of end points of the straight line of the linear surface profile section and points of inflexion of curvature of the concave line of the concave surface profile section.

4. The horse bit according to claim 2, in which one of the chord line (C), the straight line, and the concave line has a length (L1) of between about 5 mm and about 30 mm.

5. The horse bit according to claim 2, in which one of the chord line (C), the straight line, and the concave line has a length (L1) of between about 5 mm and about 15 mm.

6. The horse bit according to claim 1, in which at least one of the profile sections is located at one of a lower surface side, an upper surface side, and a lateral surface side of the shackle.

7. The horse bit according to claim 1, in which at least one of the profile sections extends over a length along the longitudinal path (A) of the shackle, wherein the length is between about 10 mm and about 150 mm.

8. The horse bit according to claim 7, in which at least one of the profile sections is located at a distance (D) from a center of the shackle, wherein the distance (D) is between about 0 mm and about 60 mm.

9. The horse bit according to claim 1, in which at least one of (a) a radius (R1) of curvature of the concave surface profile section is between about 5 mm and about 40 mm and (b) a maximum depth (H) of concavity of the concave surface profile section is between about 0.2 mm and 1 mm.

10. The horse bit according to claim 9, in which a ratio of the radius (R1) of curvature of the concave surface profile section and a distance between the two end points, at a point of maximum depth (H) of concavity is greater than or equal to 1.

11. The horse bit according to claim 9, in which a ratio of the radius (R1) of curvature of the concave surface profile section and a distance between the two end points, at a point of maximum depth (H) of concavity is between 1 and 8.

12. The horse bit according to claim 1, in which one of the angle is in a range of between about 55°±5°, where at least one of cheeks acts as a member of a first type of cheek having a single rein attachment ring freely sliding through the bore, the angle is in a range of between about 65°±5°, where the at least one cheek acts as a member of a second type of cheek having a rein attached to a ring lying below an origin of the bore, and the angle is in a range of between about 30°±5°, where the at least one cheek acts as a member of a third type of cheek having a rein attached to a ring fixed relative to the bore and a cheek bar having a longitudinal axis of which extends through the bore and wherein a cheek-piece attachment ring is provided at the end of the cheek bar.

13. The horse bit according to claim 1, in which the shackle has a curvature along the longitudinal path (A) of the shackle, wherein a radius (R2) defining the curvature is oriented substantially parallel to a radius (R1) of concavity of the concave surface profile section.

14. The horse bit according to claim 1, in which the shackle comprises at least one joint and two side portions, wherein the two side portions are connected by the at least one joint such that the side portions are pivotable to each other, wherein at least one of the side portions comprises the at least one shackle surface region.

15. The horse bit according to claim 1, in which at least one of the profile sections extends over a length along the longitudinal path (A) of the shackle, wherein the length is between about 70 mm and about 120 mm.

16. The horse bit according to claim 15, in which at least one of the profile sections is located at a distance (D) from a center of the shackle, wherein the distance (D) is between about 20 mm and about 40 mm.

17. The horse bit according to claim 1, in which at least one of the first end and the second end comprises a bore for receiving the cheeks and wherein the angle between the bore axis of the bore and the axis substantially parallel to the chord line (C) is in a range of between about 25° and about 70°.

* * * * *